US006692224B2

(12) United States Patent
Miura et al.

(10) Patent No.: US 6,692,224 B2
(45) Date of Patent: Feb. 17, 2004

(54) TURBO COMPRESSOR

(75) Inventors: Haruo Miura, Chiyoda (JP); Kazuo Takeda, Chiyoda (JP); Naohiko Takahashi, Chiyoda (JP); Hideo Nishida, Chiyoda (JP); Hiromi Kobayashi, Chiyoda (JP); Tomoyuki Ishikawa, Tsuchiura (JP)

(73) Assignee: Hitachi, Ltd., Tokyo (JP)

( * ) Notice: Subject to any disclaimer, the term of this patent is extended or adjusted under 35 U.S.C. 154(b) by 139 days.

(21) Appl. No.: 10/097,611

(22) Filed: Mar. 15, 2002

(65) Prior Publication Data

US 2003/0059299 A1 Mar. 27, 2003

(30) Foreign Application Priority Data

Sep. 25, 2001 (JP) ..... 2001-290525

(51) Int. Cl.[7] ..... F04D 29/58
(52) U.S. Cl. ..... 415/66; 415/179
(58) Field of Search ..... 415/60, 66, 68, 415/151, 148, 203, 204, 206, 179; 416/241 R

(56) References Cited

U.S. PATENT DOCUMENTS 3,001,692 A * 9/1961 Schierl ..... 415/66
3,355,096 A * 11/1967 Hornschuch ..... 415/179
3,476,485 A * 11/1969 Kunderman ..... 415/66
4,219,306 A * 8/1980 Fujino et al. ..... 415/66
6,488,467 B2 * 12/2002 Czechowski et al. .... 415/122.1

FOREIGN PATENT DOCUMENTS

JP 08-093685 4/1996

* cited by examiner

*Primary Examiner*—Edward K. Look
*Assistant Examiner*—Igor Kershteyn
(74) *Attorney, Agent, or Firm*—Crowell & Moring LLP

(57) ABSTRACT

A turbo compressor, comprising two (2) pieces of rotation shafts, being disposed in parallel with each other, wherein impellers are attached on both ends of one of the rotation shafts, thereby to build up a first-stage compressor and a second-stage compressor, while an impeller on one end of the other rotation shaft, thereby to build up a third-stage compressor. In a lower side of each of the compressors, an intercooler and an after-cooler are disposed in alignment with, for cooling down an operation gas compressed in each stage. The operation gas is guided into the first-stage compressor on a side opposing to a motor, into the second-stage compressor on a side of the motor, and into the third-stage compressor on the side opposing to the motor, in the order thereof.

16 Claims, 5 Drawing Sheets

TURBO COMPRESSOR

BACKGROUND OF THE INVENTION

The present invention relates to a turbo compressor, being mainly applied as an air source of power or into processes in a factory, and in particular, to a turbo compressor, being preferably applicable to that being constructed in three stages.

For all-purpose air compressors widely used within general industry fields, demands are made strongly upon small sizing of the turbo compressor, from requirements of lowering a cost and easiness in maintenance, etc. A requirement made upon fluid performances of the compressor is to achieve a predetermined discharge pressure at a predetermined suction flow rate. For fulfilling such the requirements, it is necessary to suppress or restrict the flow velocity of internal fluid, to be equal or less than a predetermined velocity or speed, by reducing the loss of motive power. As other requirements upon the compressor, it is that drain generating in an intercooler is prevented from being sucked from an outlet side of an intercooler into the compressor provided at the next-stage. For fulfilling such the requirement, it is necessary to suppress or restrict the flow velocity at the outlet of the intercooler, to be equal or less than a predetermined velocity or speed. However, such the requirements result into a compressor of large-scaled or large-sized.

For the purpose of achieving the down sizing of the compressor even under such the requirements as be contrary to the down sizing of the compressor, in the conventional turbo compressor, as was described, for example, in Japanese Patent Laying-Open No. 8-93685 (1996), the position is devised for each constituent element of the turbo compressor, so as to make the turbo compressor compact in size. In the compressor described in this publication, a rotation shaft is disposed in parallel with an output shaft of a driving motor through a gear apparatus. And, on both sides of the rotation shaft, a first-stage compressor and a second-stage compressor are connected to each other. Further, disposing the first-stage compressor on a side of the driving motor while the second-stage compressor on the opposite side thereof, a suction pipe and a suction filter of the first-stage compressor are positioned on a side of the driving motor.

Though the compressor mentioned in the conventional art, described in Japanese Patent Laying-Open No. 8-93685 (1996), can be made compact in sizes surely, but it is two (2) stage machine, therefore no consideration is paid into the structure for achieving the small sizing of the compressor, in particular, adopting three (3) stage structure, on which high pressure and much higher efficiency can be expected to obtain. Accordingly, there is made no consideration at all, on easiness in assembling and/or disassembling of the compressor if being structured as the three(3)-stage machine, and/or an improvement on workability thereof.

BRIEF SUMMARY OF THE INVENTION

An object, according to the present invention, for dissolving such the drawbacks according to the conventional art as was mentioned in the above, is to provide a turbo compressor, being structured in three(3)-stages, but compact in sizes and easy in assembling and/or disassembling thereof.

According to the present invention, for accomplishing the objects mentioned above, firstly, there is provided a turbo compressor, comprising: a first rotation shaft, being connected to an output shaft of a driving motor, and having a first gear means thereon; a second rotation shaft, being disposed in parallel with said first rotation shaft, and having a second gear means engages with said first gear means; a third rotation shaft, being disposed in parallel with said first rotation shaft, and having a third gear means engages with said first gear means; first-stage and second-stage impellers, being attached onto both ends of said second rotation shaft; and a third impeller attached onto one end of said third rotation shaft, wherein operation gas is guided from the first-stage impeller to the second-stage impeller, and next to the third-stage impeller, further comprising: a first cooler for cooling the operation gas compressed by said first-stage impeller; a second cooler for cooling the operation gas compressed by said second impeller; a third cooler for cooling the operation gas compressed by said third impeller; and an integrated casing accommodating at least one of said first to third coolers therein, wherein at least one of said first to third coolers is aligned sequentially in direction substantially perpendicular to said first rotation shaft, and said integrated casing accommodates at least one of said first-stage, said second-stage and said third stage rotation shafts therein.

According to the present invention, preferably, in the turbo compressor, as described in above: wherein at least one of said first to third coolers is a corrugate fin-type cooler, and is disposed below said at least one of said first-stage to said third-stage impellers; wherein said first-stage impeller and said third-stage impeller are disposed on a side opposing to the driving, while said second-stage impeller is disposed on a side of the driving motor; and wherein said each cooler is accommodated within a refrigeration chamber divided in said integrated casing, and each flow path for guiding flow coming from the impeller to the refrigeration chamber, or for guiding flow coming out from the refrigeration chamber to the impeller, contains a straight line passing through a central axis of the impeller, excepting the flow path for guiding the flow from the first-stage impeller to the first cooler.

According to the present invention, preferably, in the turbo compressor, as described in the above: wherein said first-stage impeller is detachable while keeping said second rotation shaft held on said integrated casing, and further said second rotation shaft is detachable from said integrated casing while keeping said second-stage impeller attach on said second rotation shaft; wherein material of said first-stage impeller is selected to one of aluminum alloy, titanium alloy or steel; and wherein said each refrigeration chamber is formed in almost rectangular parallelepiped shape; said cooler has a sealing portion on an upper surface and a lower surface thereof, between the integrated casing defining the refrigeration chamber; the sealing portion divides the refrigeration chamber into a flow-in portion for the operation gas flowing into the cooler and a flow-out portion for the operation gas flowing out from the cooler; and a cross-section area on a cross-section perpendicular to the rotation shaft in the divided portion is equal or greater than that on the flow-in portion.

According to the present invention, preferably, in the turbo compressor, as described in above: wherein the cross-section areas on the flow-in portions are made smaller in an order: the refrigeration chamber, in which the first cooler is accommodated, the refrigeration chamber, in which the second cooler is accommodated, and the refrigeration chamber, in which the third cooler is accommodated; wherein said cooler is made up by laminating layers alternately, in which cooling fluid or being-cooled fluid flows; the cooling fluid and the being-cooled fluid flowing in each the layer are intersected at substantially perpendicular in the flow directions; and the layer at an end portion in lamination direction is a layer in which the cooling fluid flows; wherein said cooling fluid and said being-cooled fluid are in substantially parallel to each other; and a groove is formed for maintaining a sealing rubber on a surface opposing to cooler of said integrated casing forming the refrigeration chambers, whereby sealing up by means of the sealing rubber between the upper surface or the lower surface of said cooler and said integrated casing; wherein said first to said third coolers are formed in the same shape; wherein an inlet guide vane apparatus or a suction throttle-valve is disposed on a suction side of said first-stage impeller; and wherein said integrated casing is made from a cast.

According to the present invention, also for accomplishing the object mentioned above, there s provided a turbo compressor, comprising: a first rotation shaft, being connected to a motor shaft; a second rotation shaft, on both end portions of which are attached a first-stage impeller and a second-stage impeller; and a third rotation shaft, on one end of which is attached a third-stage impeller, wherein said first, said second and said third shafts are disposed in parallel to one another, and an operation gas is guided from said first-stage impeller, said second-stage impeller, and next to said third-stage impeller, further comprising: an integrated casing accommodating the all impellers and all rotation shafts therein; a flange opening portion of a circular shape on an impeller portion of the integrated casing, in axial direction of the rotation shaft, wherein the impeller is made detachable from said opening.

According to the present invention, in the turbo compressor, as described in the above: wherein in a lower portion of the integrated casing, in which the impeller is accommodated therein, is accommodated a cooler for cooling the operation gas, being compressed by the impeller, and the cooler is accommodated in the integrated casing, so that a direction of flow of the operation gas in the cooler is perpendicular to a direction of the rotation shaft; and wherein a length of each portion of the compressor is within a length of a portion of said casing, where said cooler is accommodated, in a direction perpendicular to an axis thereof.

BRIEF DESCRIPTION OF THE SEVERAL VIEWS OF THE DRAWING

Those and other features, objects and advantages of the present invention will become more apparent from the following description when taken in conjunction with the accompanying drawings wherein.

DETAILED DESCRIPTION OF THE INVENTION

Figure 1:
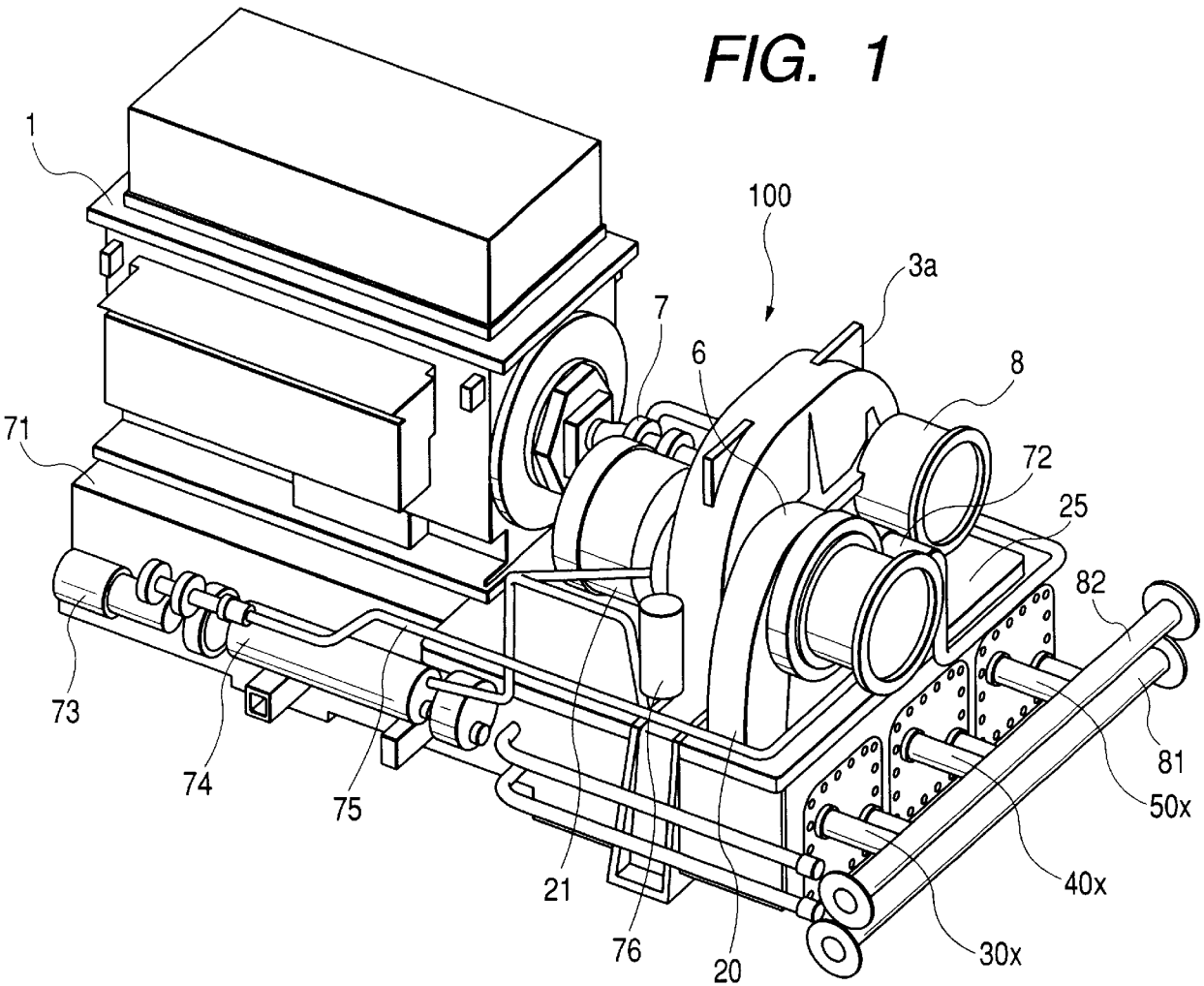
FIG. 1 is a perspective view of an embodiment of the turbo machine according to the present invention.
Figure 2:
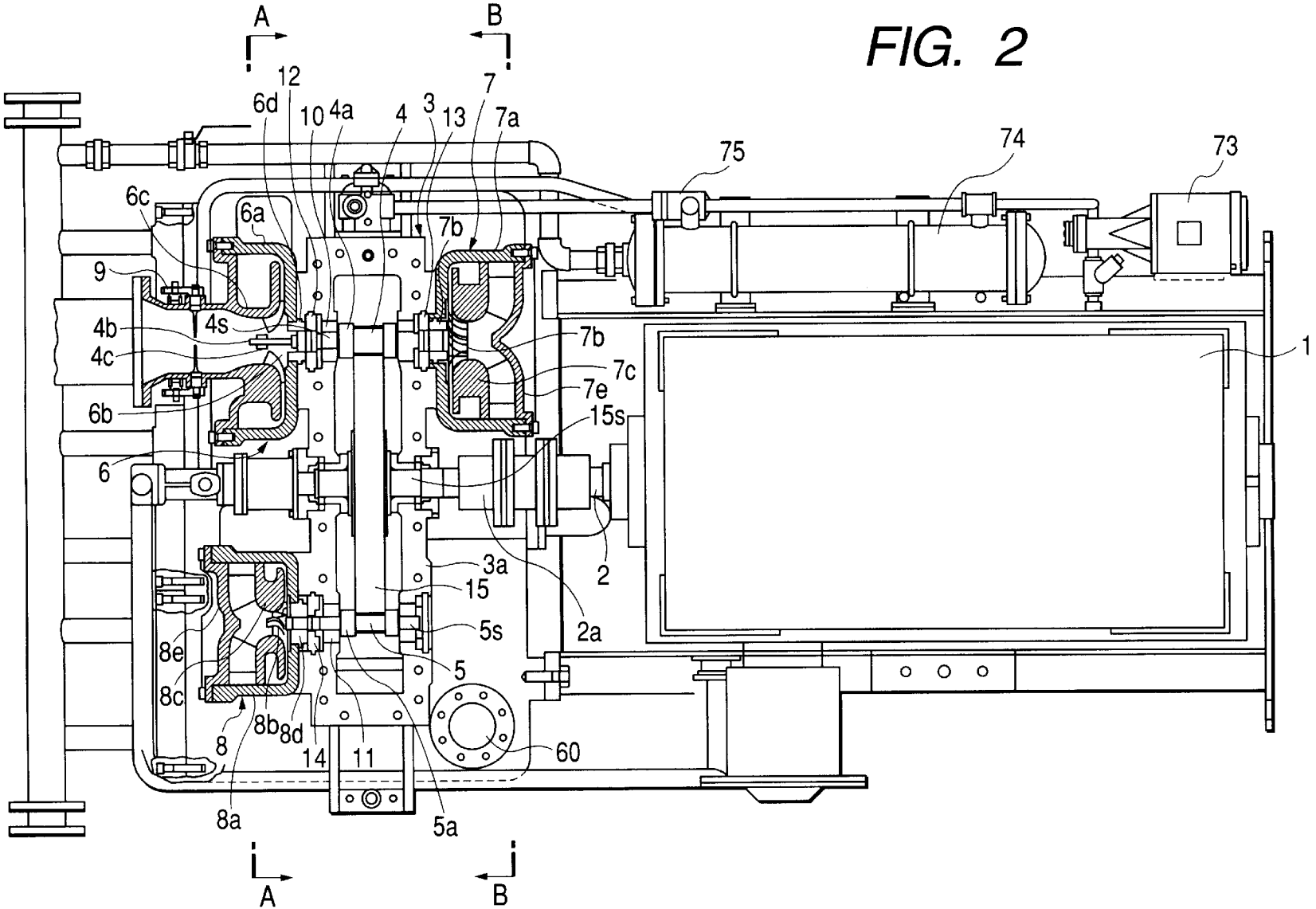
FIG. 2 is a front view of the above.
Figure 3:
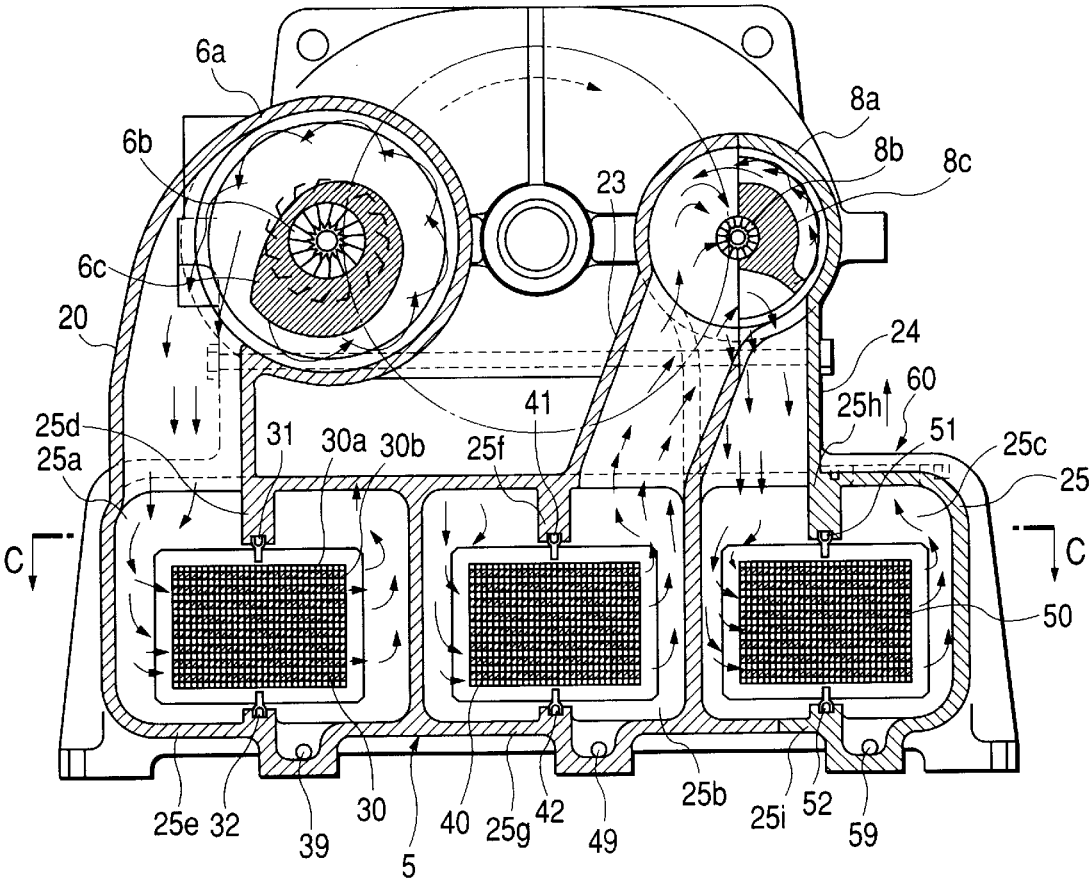
FIG. 3 is an A—A cross-section view shown in FIG. 2.
Figure 4:
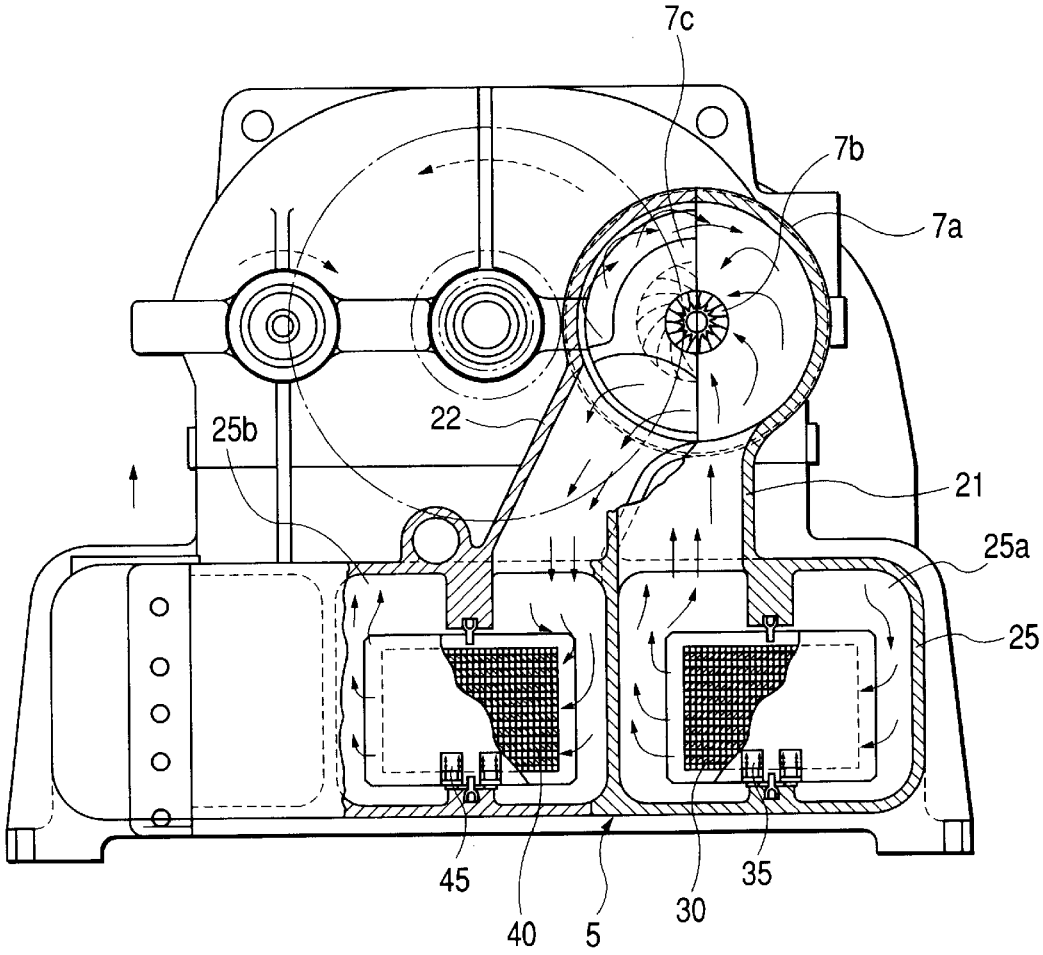
FIG. 4 is a B—B cross-section view shown in FIG. 2.
Figure 5:
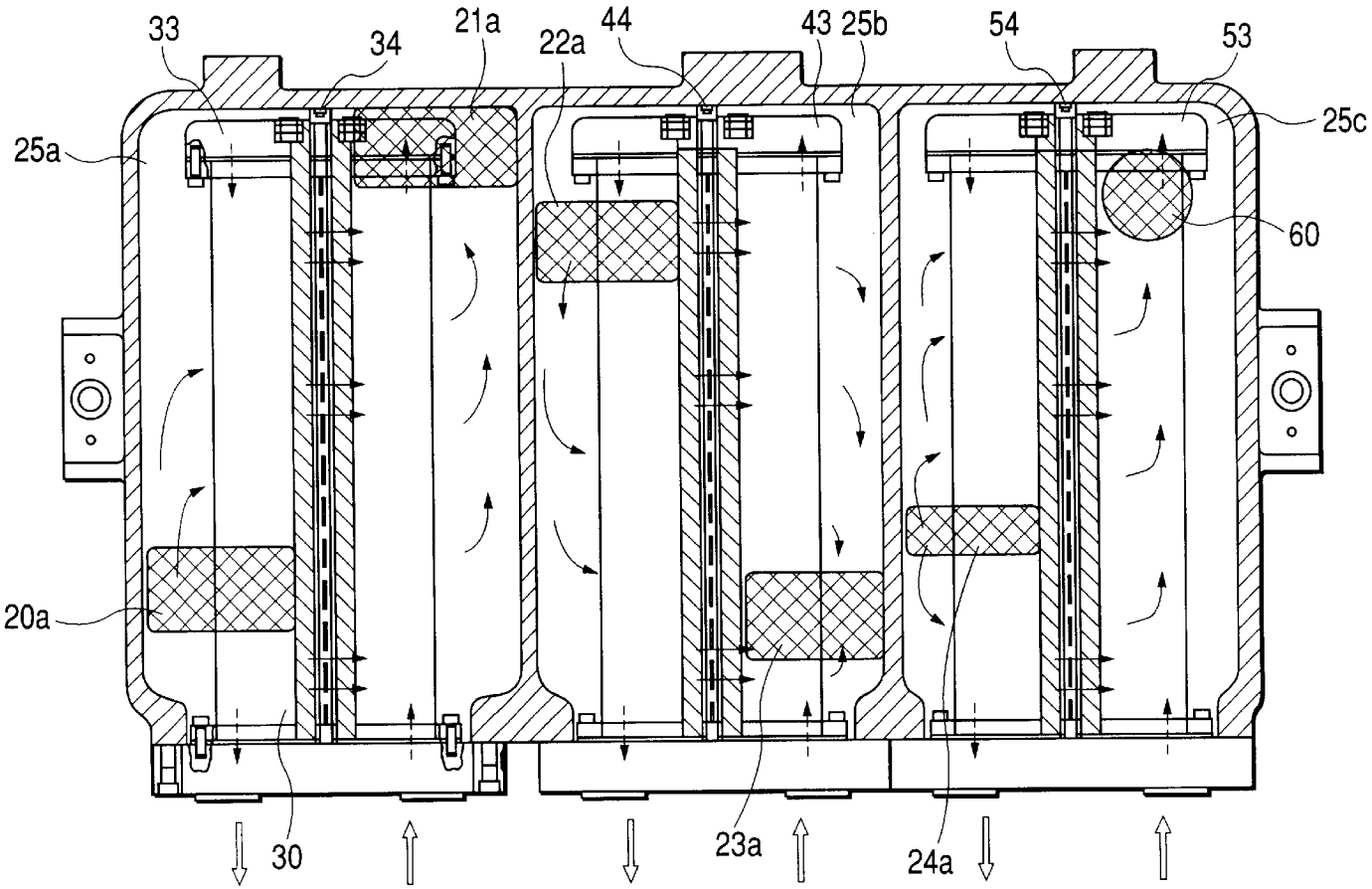
FIG. 5 is a C—C cross-section view in FIG. 3.

Hereinafter, an embodiment according to the present invention will be fully explained by referring to the attached drawings. Wherein, FIG. 1 is a perspective view of an entire of the turbo machine according to the present invention; FIG. 2 is a plan view of the turbo machine shown in FIG. 1; FIGS. 3 and 4 are the A—A cross-section view and the B—B cross-section view, seeing from sides of the arrows in the figures, respectively; and FIG. 5 is the C—C cross-section view in FIG. 3. The turbo compressor according to the present invention has three(3)-stage compressor structure.

On a motor base 71 is mounted a motor 1 having width, nearly equal to that of the motor base 71. The motor base 71 is used in common, as an oil reservoir or tank, and it receives therein a lubricating oil, to be supplied to lubrication parts and/or step-up gears in each compressor stage for lubricating thereof, which will be mentioned later. On one side of a motor 1 is extruded a motor shaft 2, to which a compressor main body 100 is connected through a coupling 2*a*. The compressor main body 100 has a first-stage compressor 6, a second-stage compressor 7 and a third-stage compressor 8. A casing of each stage of compressors is integrated with a casing of a box-like refrigeration chamber 25, which defines a first intercooler 30*x*, a second intercooler 40*x* and an aftercooler 50*x*.

As is shown in FIG. 2, an output shaft 2 of the driving motor 1 is connected to a rotation shaft 15*s* of a gear apparatus 3. The gear apparatus (i.e., a speed reducer) 3 comprises: a rotation shaft 15*s*, on a middle portion of which is formed a bull gear 15; and first and second rotation shafts 4*s* and 5*s*, on which are formed pinion gears 4 and 5, being meshed or engaged with the bull gear 15. The first rotation shaft 4*s* is supported by a shaft bearing 10 at both ends of the pinion gear 4, while the second rotation shaft 5*s* by a shaft bearing 11 at both ends of the small gear 5. The first and the second rotation shafts 4*s* and 5*s* are disposed in parallel with the rotation shaft 15*s*, respectively.

On both end portions of the first rotation shaft 4*s* are attached an impeller of the first-stage compressor 6 and an impeller of the second-stage compressor 7, respectively. The first-stage compressor 6 is attached on the side opposite to the driving motor 1, while the second-stage compressor 7 on the side of the driving motor 1. At an end of the second rotation shaft is attached an impeller of the third-stage compressor 8. For simplification of piping for an operation gas, according to the present embodiment, the third-stage compressor is disposed on the side opposite to the driving motor 1.

The first-stage compressor comprises: the impeller 6*b* attached onto the first rotation shaft; a diaphragm 6*c* for defining a vane tip side of the stator; and a scroll casing 6*a* for defining hub side of the stator, together with the diaphragm 6*c*. The diaphragm 6*c* and the impeller 6*b* are housed inside the scroll casing 6*a*. In an upstream side of the impeller 6*b* of the firs-stage compressor is disposed an inlet guide vane apparatus 9.

The second-stage compressor comprises: an impeller 7*b;* a diaphragm 7*c* for defining the vane tip side of the stator; a scroll casing 7*a* housing those impeller 7*a* and diaphragm 7*c* therein, and for hub side of the stator; and an end plate 7*e* for defining the static flow path on a suction side. In the similar manner, the third-stage compressor comprises: an impeller 8*b;* a diaphragm 8*c* for defining a vane tip side of the stator; a scroll casing 8*a* housing those impeller 8*a* and diaphragm 8*c* therein, and for defining the hub side of the stator; and an end plate 8*e* for defining the static flow path on the suction side. The operation fluid, flowing inside the compressor of the each stage, is prevented from leaking into the side of the speed reducer 3, thereby to flow outside, by means of a stage labyrinths 6*d,* 7*d* and 8*d*. Further, the scroll casing 6*a,* 7*a,* or 8*a* of compressor of the each stage is constructed by means of a cast, being integrated with the gear casing 3*a*.

With the present embodiment constructed in this manner, the compressor of the each stage is assembled in the following manner. The scroll casings 6*a*, 7*a* and 8*a*, each being opened at one end, are attached onto a casing of the speed reducer 3 portion. Next, onto both end portions of the first rotation shaft 4*s* are attached the impellers 6*b* and 7*b*. In this instance, as will be shown in more details of the first-stage compressor, a locking bolt 4*b* is buried in the first rotation shaft 4*s*, and after engaging or fitting the impeller 6*b* onto the first rotation shaft 4*s*, a nut 4*c* is put on the locking bolt 4*b* and screwed up by a predetermined torque. However, on the first rotation shaft 4*s* are formed a locking bolt portion and a faucet or socket portion at a shaft end portion thereof. In a central portion of the impeller 6*b* is formed a faucet portion (i.e., a bore) extending into the axial direction thereof. The length of the faucet portion of the impeller 6*b* in the axial direction is made corresponding to an outer radius of the first rotation shaft 4*s* to be fitted therein. And, the first-stage impeller is made of one of titanium alloy, steel or aluminum alloy, thereby being detachable easily onto the first rotation shaft. The second-stage compressor has the same structure. With the third-stage compressor, the impeller 8*b* is attached on one end portion of the second rotation shaft 5*s*, by means of a bolt and a nut not shown in the figure.

The diaphragm 6*c*, 7*c* or 8*c* of the each stage is engaged with the scroll casing 6*a*–8*a* from the open-end side of the scroll casing 6*a*, 7*a* or 8*a*, respectively, in the axial direction thereof. In case of the first-stage compressor, under this condition, a flange portion formed on the diaphragm 6*c* is fastened on an outer-diameter side thereof, by means of the bolts. In cases of the second-stage compressor and the third-stage compressor, further the end plates 7*e* and 8*e* are engaged with the scroll casing 6*a*–8*a* from the open-end sides of the diaphragms 7*c* and 8*c*, and then the flange portions formed on the end plates 7*e* and 8*e* are fastened on the outer-diameter sides thereof, by means of the bolts. Herein, an outer diameter of housing of the shaft bearing 10 supporting the first rotation shaft, an outer diameter (i.e., the faucet diameter) of a portion of the stage labyrinth 6*d*, which is disposed on a rear surface side of the hub of the impeller, being attached onto the scroll casing 6*a*, and an outer diameter (i.e., the faucet diameter) of an oil seal labyrinth 12 provided in a middle portion on an axial direction between the shaft bearing 10 and the stage labyrinth 6*d*, are made larger than the outer diameter of a thrust collar 4*a* disposed on both sides of the small gear 4 attached onto the first rotation shaft. The relationships in sizes of those diameters can be also applied to the second-stage compressor and the third-stage compressor, in the same manner.

FIG. 3 shows horizontal cross-section views of the first-stage compressor and the third-stage compressor, as well as the channel or passage of the operation gas to each cooler. In the similar manner, FIG. 4 shows the horizontal cross-section views of the second-stage compressor and the passage of the operation gas to each cooler. Below the first-stage compressor, the second-stage compressor, the third-stage compressor, and the gear apparatus is provided a box 5 of a substantially parallelepiped, being separated into three (3) inside thereof, in the width direction of the driving motor 1. Each separated portion defines a refrigeration chamber. Within the refrigeration chamber 25*a* at the most left-hand side in FIG. 3 is accumulated an intercooler 30 for cooling down the operation gas discharged from the first-stage compressor to be guided into the second-stage compressor. Within the refrigeration chamber 25*b* neighboring with this refrigeration chamber 25*a* is accumulated an intercooler 40 for cooling down the operation gas discharged from the second-stage compressor to be guided into the third-stage compressor. Within the further neighboring refrigeration chamber 25*c* is accumulated an after-cooler 50 for cooling down the operation gas discharged from the third-stage compressor to be discharged out.

In FIG. 3, the fluid sucked into the first-stage impeller 6*b* is compressed by the first-stage impeller and flows in the static flow path defined by the diaphragm 6*c* and the scroll casing 6*a*. Then, the gas is guided from a discharge nozzle 20 disposed at the most left-hand side into the refrigeration chamber 25*a* at the most left-hand side. The gas flows into the cooler 30 disposed within the refrigeration chamber 25*a*, from a side surface portion (i.e., the surface on the left-hand side in FIG. 3) thereof, and then flows out from the surface portion on the right-hand side of the cooler 30. The operation gas coming out from the cooler 30 is collected on the rear surface side in FIG. 3, and is sucked into the second-stage impeller 7*b* from a second-stage suction nozzle 21, which is connected to the refrigeration chamber 25*a*, as is shown in detail in FIG. 4.

The cross-section of the second-stage compressor in FIG. 4 defines a diaphragm portion in a halt thereof at the right-hand side portion, while the remaining half thereof at the left-hand side the cross-section of the discharge scroll portion. The operation gas sucked from the suction nozzle 21 of the second-stage compressor, after being compressed by the impeller 7*b* of the second-stage compressor, flows in the static flow path defined by the diaphragm 7*c* and the scroll casing 7*a*, and it is guided into the central refrigeration chamber 25*b* from the discharge nozzle 22. Then, it flows into the cooler 40 disposed within the refrigeration chamber 25*b* from the surface portion thereof at the right-hand side, and flows out from the surface portion of the cooler 40 at the left-hand side. The operation gas coming out from the cooler 40 is collected on the rear surface side in FIG. 4, and is sucked into the third-stage impeller 8*b* from a third-stage suction nozzle 23, which is connected to the refrigeration chamber 25*b*, as is shown in detail in FIG. 3.

The cross-section of the third-stage compressor in FIG. 3 defines the diaphragm portion in a half thereof at the right-hand side, while the remaining half thereof at the left-hand side the cross-section of the discharge scroll portion. The operation gas, being compressed by the impeller 8*b* of the third-stage compressor, flows in the static flow path defined by the diaphragm 8*c* and the scroll casing 8*a*, and then is guided into the refrigeration chamber 25*c* at the right-hand side from the discharge nozzle 24. And it flows into the cooler 50 disposed within the refrigeration chamber 25*c*, from the surface portion thereof at the left-hand side, and flows out from the surface portion of the cooler at the right-hand side. The operation gas coming out from the cooler 50 is collected on the rear surface side shown in FIG. 3, and is transferred to a customer from a gas discharge opening 61 (see FIG. 2), which is provided on an upper surface of the refrigeration chamber 25*c*. Accordingly, except for a portion sucked by the first-stage compressor, any one of the suction flow and the discharge flow on each stage comes into a flow in radial direction. Further, in FIGS. 3 and 4 are indicated the flows of operation gas on the each stage, by arrows.

FIG. 5 shows a positional relationship of the box 25 defining the refrigeration chambers, and each of the nozzles and the coolers therein. This FIG. 5 is the C—C cross-section view seen from the arrows in FIG. 3. The operation gas compressed in the first-stage compressor, as was mentioned in the above, enters into the first refrigeration chamber 25*a* from the discharge nozzle 20. In this instance, it enters into the refrigeration chamber 25*a* from an opening 20*a* formed in a front portion (i.e., on the side opposite to the motor) of the refrigeration chamber 25*a*. After being cooled down in the first cooler (i.e., the intercooler) 30, it flows out from an opening 21*a,* which is formed in a rear portion (i.e., on the side of the motor) of the refrigeration chamber 25*a*. The operation gas, being compressed in the second-stage compressor, flows into the refrigeration chamber 25*b* from an opening 22*a,* which is formed in a rear portion (i.e., on the side of the motor) of the second refrigeration chamber 25*b*. The operation gas, being cooled down in the second cooler (i.e., the intercooler) 40, flows out from an opening 23*a,* which is formed in a front portion (i.e., on the side opposite to the motor) of the refrigeration chamber 25*b*.

The operation gas, being compressed in the third-stage compressor, flows into the refrigeration chamber from an opening 24*a,* which is formed in a front portion (i.e., on the side opposite to the motor) of the third refrigeration chamber 25*c*. After being cooled down in the third cooler (i.e., the after-cooler) 50, flows out from an opening 60, which is formed in a rear portion (i.e., on the side of the motor) of the refrigeration chamber 25*c*. For building up such the flow, all the connection portions, between the suction portion and the discharge portion of the each stage, are provided on the upper surface of the refrigeration chamber. Accordingly, the suction nozzle, the discharge nozzle and the refrigeration chamber in the box-like shape for the each stage can be integrated together with the compressor scroll casing and the gear casing.

As was shown in FIG. 3, on the upper surface and the lower surface of the refrigeration chamber, being formed almost in the rectangular parallelepiped shape, are formed sealing grooves 25*d*–25*i*. With those sealing grooves 25*d*–25*i* are engaged sealing portions 31, 32, 41, 42, 51 and 52 on the side of the each cooler, thereby preventing the operation gas, being compressed and at high temperature, from flowing into the downstream side. On the rear surface side of each cooler, 30, 40 or 50 is provided a cooling water return header 33, 43 or 53. Between the cooling water return header 33, 43 or 53 and the each cooler 30, 40 or 50 is provided a sealing part 34, 44 or 54. The sealing part is preferably made from a rubber material.

In the each cooler 30, 40 or 50 flows cooling water, therefore the cooling water cools down the operation gas that is compressed by the impeller of the each stage. The flow direction of the cooling water is nearly orthogonal to the flow direction of the operation gas, and is guided into the each cooler 30, 40 or 50 from the lower side thereof shown in FIG. 5, thus, being changed in direction by 180 degree through the cooling water return header 33, 43 or 53, to flow into. It is discharged into the lower side in FIG. 5. The cooling water flowing into the each cooler is supplied from a cooling water collector pipe 81, and it is collected into a cooling water supply pipe, to be guided into a cooling tower not shown in the figure (see FIG. 1). Further, if the each cooler is made up with a so-called corrugate fin-type heat exchanger, the entire of the cooler can be made small in size.

On each of the cooling water return heads 33, 34 and 35 are provided rollers 35 and 45, projecting a little bit from the lower surface of the each cooler. This protects each the cooler from touching on the refrigeration chamber when the cooler is assembled into, or disassembled or removed therefrom, and it also keeps the sealing member held into the groove appropriately. Further, as was shown in FIGS. 3 and 4 in the above, each of the refrigeration chambers 25*a*–25*c* forms two (2) rooms at both sides (i.e., the right-hand side and the left-hand side), by a stay portion, on which the sealing grooves are formed on the upper surface side and the lower surface side of the refrigeration chamber for holding the cooler thereon, and by the cooler. The position of the stay portion is determined as follows. In FIG. 3, the room of the inlet side, corresponding to the left-hand side room of the each refrigeration chamber, is so determined that it has a cross-section area perpendicular to the shaft, being equal or larger than that of the outlet room corresponding to the right-hand side thereof. In this instance, on area of the cooler is removed from the cross-section area of the two rooms. For the purpose of bringing the compressor as a whole to be compact in sizes, a ratio in the cross-section area perpendicular to the shaft between the outlet side and the inlet side is made larger, in the order of: the third-stage refrigeration chamber 25*c,* the second-stage refrigeration chamber 25*b,* and the first-stage refrigeration chamber 25*a*.

According to the present embodiment, 1) the first stage impeller is made detachable into/from the casing while being attached onto the rotation shaft. Since the first-stage impeller is disposed on the side opposing to the motor, interference can be prevented from occurring between the first-stage scroll having a large diameter and the driving shaft of the motor. Since the diameter of the second-stage scroll can be made smaller than the diameter of the first-stage scroll, the entire of the compressor can be small in size. Furthermore, the first-stage is located on the side where no motor is provided, the inlet guide vane apparatus can be attached easily in the upstream of the first-stage impeller. The attachment and/or removal of the first-stage impeller can be done easy.

2) Since the outer diameter of the housing of the shaft bearing, the faucet diameter of the stage labyrinth, and also the faucet diameter of the oil seal labyrinth are made larger than the outer diameter of the thrust collar, which is attached on the rotation shaft, therefore the first rotation shaft can be removed in the axial direction after removing the first-stage impeller therefrom.

3) Since the flow in the suction portion and the discharge portion of the each stage are directed into the radial direction, but except for the suction portion of the first stage, opening portions of the nozzles directing the radial direction can be connected onto the upper surface, easily. As a result, the length of the flow path connecting between the each cooler and the compressor of the each stage can be shorter, thereby reducing the loss.

4) Since the ratio is made equal or greater than one (1), in the cross-section area perpendicular to the shaft at the outlet side and the inlet side of the each refrigeration chamber, the flow velocity of gas can be lowered on the outlet side of the cooler, thereby enabling separation of the compressed drain from the gas due to the free fall thereof, therefore an efficiency of separation can be improved. The area ratio is made larger in the order: the third refrigeration chamber, the second refrigeration chamber, and the first refrigeration chamber, and then the sizes of the refrigeration chambers can be made compact. Furthermore, the flow velocity of the first-stage compressor can be reduced down to that of the third-stage compressor, thereby increasing the efficiency of drain separation.

5) It is only the needed the step-up gear, the shaft bearing, and the shaft sealing apparatus between the impellers on the rotation shaft, on which the impellers are attached at both ends thereof, the distance between the impellers can be made shorter than the length of the cooler. Thus, the impellers can be disposed on the coolers. Saying conversely, the coolers can be made small in sizes down to a degree of the distance between the both impellers, therefore the flow paths connecting between the cooler casing and the compressor casings can be formed easily.

6) Since the both end portions of the cooler are adopted as the cooling water header or the cooling water chamber, then the rubber seal can be used for preventing the leakage of the high temperature operation gas.

7) Since the first-stage impeller can be removed from the first rotating shaft while the first rotation shaft is attached to the compressor, then the first rotation shaft can be removed out into the side of the motor while the second impeller is attached onto the first rotation shaft. Similarly, the second rotation shaft can be removed out in the side opposing to the motor while the impeller of the third-stage compressor is attached onto the second rotation shaft, therefore the assembling can be made easily.

8) Since the stage labyrinth is provided on the rear surface of the impeller, while the diameter of the faucet portion of the labyrinth is made larger than the outer diameter of the thrust collar of the rotation shaft, and within the gear casing and the upper casing portion is provided a long space portion, being longer than the length of the labyrinth in the axial direction, therefore the labyrinth can be attached to or removed from the scroll casing of the compressor from the side of the step-up gear.

9) The cooler to be attached onto the refrigeration chamber is structured in the following manner. Thus, two (2) flows of the operation fluids, i.e., a cooling side and a being-cooled side are intersected in perpendicular to each other, being separated by a partition plate therebetween. In this instance, a layer in which the fluid of the cooling flows and the neighboring layer in which the gas of the being-cooled flows are laminated one by one in plural numbers of layers. The cooling sides are defined or located on both end sides along the direction of lamination thereof and the each cooler makes up the so-called corrugate fin-type heat exchanger. With this can be obtained a high performance as about two(2)-times high as that of a plate-type heat exchanger, and the heat exchanger, being compact in sizes and having high efficiency, can be applied into the turbo compressor.

However, in the embodiment(s) mentioned above, each cooler can be used in common. In that case, it is possible to reduce the number of the parts to be reserved for when abnormal condition occurs therein. The impeller of the first-stage compressor comes to be larger in the diameter, comparing to that of the impellers of the other stages, therefore, it is preferable to be made of a light-weight material, for the purpose of reduction in an overhang weight due to the impeller. For that purpose, the impeller is made up, by using an aluminum alloy or titanium ally, according to the present embodiment. For the impeller of the second-stage and third-stage, it is preferable to use a precipitation hardening type of stainless steel, because of flow-in of the operation gas, which contains condensed water being cooled in the cooler.

As was mentioned in the above, according to the present invention, in which structure, the first-stage compressor, the second-stage compressor and the third-stage compressor, including the gear apparatus and the refrigeration chambers accommodating the coolers therein, are integrated, in one casing, therefore the entire structure of the three(3)-stage turbo compressor can be made compact in sizes. Since the turbo compressor is made small in sizes, an installation area can be reduced down. Further, with the integration of the casing, construction and/or maintenance thereof also come to be easy.

While we have shown and described several embodiments in accordance with our invention, it should be understood that the disclosed embodiments are susceptible of changes and modifications without departing from the scope of the invention. Therefore, we do not intend to be bound by the details shown and described herein but intend to cover all such changes and modifications falling within the ambit of the appended claims.

What is claimed is:

1. A turbo compressor, comprising:

a first rotation shaft, being connected to an output shaft of a driving motor, and having a first gear means thereon;

a second rotation shaft, being disposed in parallel with said first rotation shaft, and having a second gear means engages with said first gear means;

a third rotation shaft, being disposed in parallel with said first rotation shaft, and having a third gear means engages with said first gear means;

first-stage and second-stage impellers, being attached onto both ends of said second rotation shaft; and a third impeller attached onto one end of said third rotation shaft, wherein operation gas is guided from the first-stage impeller to the second-stage impeller, and next to the third-stage impeller, further comprising:

a first cooler for cooling the operation gas compressed by said first-stage impeller;

a second cooler for cooling the operation gas compressed by said second impeller;

a third cooler for cooling the operation gas compressed by said third impeller; and an integrated casing accommodating at least one of said first to third coolers therein, wherein at least one of said first to third coolers is aligned sequentially indirection substantially perpendicular to said first rotation shaft, and said integrated casing accommodates at least one of said first, said second and said third rotation shafts therein.

2. A turbo compressor, as described in claim 1, wherein at least one of said first to third coolers is a corrugate fin-type cooler, and is disposed below said at least one of said first-stage to said third-stage impellers.

3. A turbo compressor, as described in claim 2, wherein said first-stage impeller and said third-stage impeller are disposed on a side opposite to the driving motor, while said second-stage impeller is disposed on a side of the driving motor.

4. A turbo compressor, as described in claim 3, wherein said each cooler is accommodated within a refrigeration chamber divided in said integrated casing, and each flow path for guiding flow coming from the impeller to the refrigeration chamber, or for guiding flow coming out from the refrigeration chamber to the impeller, contains a straight line passing through a central axis of the impeller, excepting the flow path for guiding the flow from the first-stage impeller to the first cooler.

5. A turbo compressor, as described in claim 4, wherein said each refrigeration chamber is formed in almost rectangular parallelepiped shape; said cooler has a sealing portion on an upper surface and a lower surface thereof, between the integrated casing defining the refrigeration chamber; the sealing portion divides the refrigeration chamber into a flow-in portion for the operation gas flowing into the cooler and a flow-out portion for the operation gas flowing out from the cooler; and a cross-section area on a cross-section perpendicular to the rotation shaft in the divided portion is equal or greater than that on the flow-in portion.

6. A turbo compressor, as described in claim 5, wherein the cross-section areas on the flow-in portions are made smaller in an order: the refrigeration chamber, in which the first cooler is accommodated, the refrigeration chamber, in which the second cooler is accommodated, and the refrigeration chamber, in which the third cooler is accommodated.

7. A turbo compressor, as described in claim 4, wherein said cooler is made up by laminating layers alternately, in which cooling fluid or being-cooled fluid flows; the cooling fluid and the being-cooled fluid flowing in each the layer are intersected at substantially perpendicular in the flow directions; and the layer at an end portion in lamination direction is a layer in which the cooling fluid flows.

8. A turbo compressor, as described in claim 7, wherein said cooling fluid and said being-cooled fluid are in substantially parallel to each other; and a groove is formed for maintaining a sealing rubber on a surface opposing to cooler of said integrated casing forming the refrigeration chambers, whereby sealing up by means of the sealing rubber between the upper surface or the lower surface of said cooler and said integrated casing.

9. A turbo compressor, as described in the claim 3, wherein said first-stage impeller is detachable while keeping said second rotation shaft held on said integrated casing, and further said second rotation shaft is detachable from said integrated casing while keeping said second-stage impeller attach on said second rotation shaft.

10. A turbo compressor, as described in the claim 3, wherein material of said first-stage impeller is selected to one of aluminum alloy, titanium alloy or steel.

11. A turbo compressor, as described in claim 3, wherein said first to said third coolers are formed in the same shape.

12. A turbo compressor, as described in claim 3, wherein an inlet guide vane apparatus or a suction throttle-valve is disposed on a suction side of said first-stage impeller.

13. A turbo compressor, as described in claim 3, wherein said integrated casing is made from a cast.

14. A turbo compressor, comprising:

a first rotation shaft, being connected to a motor shaft;

a second rotation shaft, on both end portions of which are attached a first-stage impeller and a second-stage impeller; and a third rotation shaft, on one end of which is attached a third-stage impeller, wherein said first, said second and said third shafts are disposed in parallel to one another, and an operation gas is guided from said first-stage impeller, said second-stage impeller, and next to said third-stage impeller, further comprising:

an integrated casing accommodating the all impellers and all rotation shafts therein;

a flange opening portion of a circular shape on an impeller portion of the integrated casing, in axial direction of the rotation shaft, wherein at least one of the impellers is made detachable from said opening.

15. A turbo compressor, as described in claim 14, wherein in a lower portion of the integrated casing, in which the impeller is accommodated therein, is accommodated a cooler for cooling the operation gas, being compressed by the impeller, and the cooler is accommodated in the integrated casing, so that a direction of flow of the operation gas in the cooler is perpendicular to a direction of the rotation shaft.

16. A turbo compressor, as described in claim 15, wherein a length of each portion of the compressor is within a length of a portion of said casing, where said cooler is accommodated, in a direction perpendicular to an axis thereof.

* * * * *